US007760056B2

(12) United States Patent
Utsunomiya et al.

(10) Patent No.: US 7,760,056 B2
(45) Date of Patent: Jul. 20, 2010

(54) ELECTROMAGNETIC SWITCH FOR USE IN STARTER

(75) Inventors: Yamato Utsunomiya, Kariya (JP); Tadahiro Kurasawa, Chita-gun (JP)

(73) Assignee: Denso Corporation, Kariya (JP)

( * ) Notice: Subject to any disclaimer, the term of this patent is extended or adjusted under 35 U.S.C. 154(b) by 52 days.

(21) Appl. No.: 11/984,600

(22) Filed: Nov. 20, 2007

(65) Prior Publication Data

US 2008/0122564 A1 May 29, 2008

(30) Foreign Application Priority Data

Nov. 29, 2006 (JP) ..... 2006-322215

(51) Int. Cl.
*H01H 67/02* (2006.01)

(52) U.S. Cl. ..... 335/126; 335/131

(58) Field of Classification Search ..... 439/203, 439/810–814, 877; 335/126
See application file for complete search history.

(56) References Cited

U.S. PATENT DOCUMENTS

| | | | | | |
|---|---|---|---|---|---|
| 2,774,951 | A * | 12/1956 | Hammell et al. | ..... | 439/849 |
| 2,921,287 | A * | 1/1960 | Anderson et al. | ..... | 439/849 |
| 3,163,484 | A * | 12/1964 | Collins et al. | ..... | 439/849 |
| 4,293,835 | A * | 10/1981 | Davis et al. | ..... | 335/131 |
| 4,731,555 | A * | 3/1988 | Torimoto et al. | ..... | 310/71 |
| 4,764,133 | A * | 8/1988 | Kaneko | ..... | 439/889 |
| 5,181,866 | A * | 1/1993 | Jerome et al. | ..... | 439/850 |
| 5,214,401 | A * | 5/1993 | Kimura et al. | ..... | 335/126 |
| 5,663,699 | A | 9/1997 | Shiroyama | | |
| 5,703,551 | A * | 12/1997 | Lefebvre et al. | ..... | 335/126 |
| 5,812,041 | A * | 9/1998 | Ishikawa et al. | ..... | 335/126 |
| 6,086,433 | A * | 7/2000 | Hils et al. | ..... | 439/849 |
| 6,204,742 | B1 * | 3/2001 | Hisamoto et al. | ..... | 335/126 |
| 6,762,663 | B2 | 7/2004 | Andoh et al. | | |
| 6,798,328 | B2 * | 9/2004 | Uchiyama | ..... | 336/208 |
| 6,846,206 | B2 * | 1/2005 | Kling et al. | ..... | 439/884 |
| 7,038,563 | B2 | 5/2006 | Andoh et al. | | |
| 7,414,501 | B2 * | 8/2008 | Imanishi et al. | ..... | 335/132 |

FOREIGN PATENT DOCUMENTS

| | | |
|---|---|---|
| JP | A-9-69327 | 3/1997 |
| JP | A-2002-313205 | 10/2002 |

OTHER PUBLICATIONS

Korean Office Action for Korean Application No. 10-2007-0122042, dated Feb. 19, 2010, with English Translation.

Translation of Chinese Office Action issued Nov. 20, 2009 in Chinese Application No. 200710167371.9.

* cited by examiner

*Primary Examiner*—Elvin G Enad
*Assistant Examiner*—Alexander Talpalatskiy
(74) *Attorney, Agent, or Firm*—Oliff & Berridge, PLC

(57) ABSTRACT

The electromagnetic switch for use in a starter includes a solenoid including an excitation coil and a plunger, and an energization terminal through which a current is supplied to the excitation coil from an external battery. The excitation coil generating, when applied with the current, a magnetic attraction force to move the plunger in order to close a main contact of the starter to thereby energize a motor of the starter. The energization terminal is constituted by a male terminal having a plate-like shape and insert-molded in the mold cover, and a female terminal fixed to a coil bobbin of the excitation coil and connected with a lead wire of the excitation coil, the female terminal being provided with a fitting section to which the male terminal is fitted so that the male and female terminals are electrically connected to each other.

3 Claims, 6 Drawing Sheets

ELECTROMAGNETIC SWITCH FOR USE IN STARTER

CROSS-REFERENCE TO RELATED APPLICATION

This application is related to Japanese Patent Application No. 2006-322215 filed on Nov. 29, 2006, the contents of which are hereby incorporated by reference.

BACKGROUND OF THE INVENTION

1. Field of the Invention

The present invention relates to an electromagnetic switch used for opening and closing a main contact of a motor circuit of a starter.

2. Description of Related Art

There is disclosed, in Japanese Patent Application Laid-open No. 2002-313205, an electromagnetic switch in use for a starter, which has a plate-like terminal that is connected to a lead wire of an excitation coil (this terminal being referred to as "50 terminal" hereinafter). This plate-like 50 terminal is pressure-fixed to a coil bobbin of the excitation coil, and its front end is led out from a mold cover through an insertion hole formed in this mold cover. A gap between the insertion hole and the 50 terminal is airtight sealed by a rubber seal member pressure-fitted to the 50 terminal.

In the conventional electromagnetic switch described above, the 50 terminal is not fixed to the mold cover. That is, since the 50 terminal is only inserted into the insertion hole formed in the mold cover through the seal member, it is difficult to suppress the 50 terminal from vibrating when the electromagnetic switch is applied with a large vibrational load. The vibration of the 50 terminal may cause the lead wire of the excitation coil connected to the 50 terminal to break. As a technique to cope with this problem, as shown in FIG. 10, it is known to use, as the 50 terminal 100, a bolt that is tightly fastened to the mold cover 120 by use of the cup washer 110 or a nut.

However, this conventional technique has a problem in that since it needs, in addition to the bolt as the 50 terminal, various parts including the cup washer 110 for fixing this bolt to the mold cover 120, the terminal 140 to which the lead wire of the excitation coil 130 is connected, and the connector 150 for electrical connection between the terminal 140 and the bolt as the 50 terminal. Besides, since the 50 terminal is a bolt, it is difficult to employ the shape of a waterproof coupler unlike the case in which a plate-like terminal is used as the 50 terminal.

SUMMARY OF THE INVENTION

The present invention provides an electromagnetic switch for use in a starter comprising:

an excitation coil;

an energization terminal through which a current is supplied to the excitation coil from an external battery; and a mold cover made of resin and housing the excitation coil and the energization terminal;

wherein the energization terminal is constituted by a male terminal having a plate-like shape and insert-molded in the mold cover, and a female terminal fixed to a coil bobbin of the excitation coil and connected with a lead wire of the excitation coil, the female terminal being provided with a fitting section to which the male terminal is fitted so that the male and female terminals are electrically connected to each other.

The present invention also provides an electromagnetic switch for use in a starter comprising:

an excitation coil;

an energization terminal through which a current is supplied to the excitation coil from an external battery; and a mold cover made of resin and housing the energization terminal;

wherein the energization terminal is constituted by a male terminal having a plate-like shape and insert-molded in the mold cover, and a female terminal fixed to a coil bobbin of the excitation coil and connected with a lead wire of the excitation coil, the female terminal is provided with a fitting section to which the male terminal is fitted so that the male and female terminals are electrically connected to each other, and a guide section for guiding an end of the male terminal to the fitting section, the mold cover is formed with a terminal inserting section receiving therein the female terminal, and the male terminal is fitted to the fitting section formed in the female terminal within the terminal inserting section, and a free end of the guide member is in contact with an inner surface of the terminal inserting section.

The present invention also provides an electromagnetic switch for use in a starter comprising:

an excitation coil;

an energization terminal through which a current is supplied to the excitation coil from an external battery; and a mold cover made of resin and housing the energization terminal;

wherein the energization terminal is constituted by a female terminal insert-molded in the mold cover, and a male terminal fixed to a coil bobbin of the excitation coil and connected with a lead wire of the excitation coil, the female terminal being provided with a fitting section to which the male terminal is fitted so that the male and female terminals are electrically connected to each other.

The present invention also provides an electromagnetic switch for use in a starter comprising:

a solenoid including an excitation coil, and a plunger;

an energization terminal through which a current is supplied to the excitation coil from an external battery; and a mold cover made of resin and housing the energization terminal;

the excitation coil generating, when applied with the current, a magnetic attraction force to move the plunger in order to close a main contact of the starter to thereby energize a motor of the starter, wherein the energization terminal is constituted by a male terminal having a plate-like shape and insert-molded in the mold cover, and a female terminal fixed to a coil bobbin of the excitation coil and connected with a lead wire of the excitation coil, the female terminal being provided with a-fitting section to which the male terminal is fitted so that the male and female terminals are electrically connected to each other.

According to the present invention, it is possible to provide an electromagnetic switch for use in a starter, which has a small parts count and high vibration resistance.

Other advantages and features of the invention will become apparent from the following description including the drawings and claims.

PREFERRED EMBODIMENTS OF THE INVENTION

First Embodiment

Figure 1:
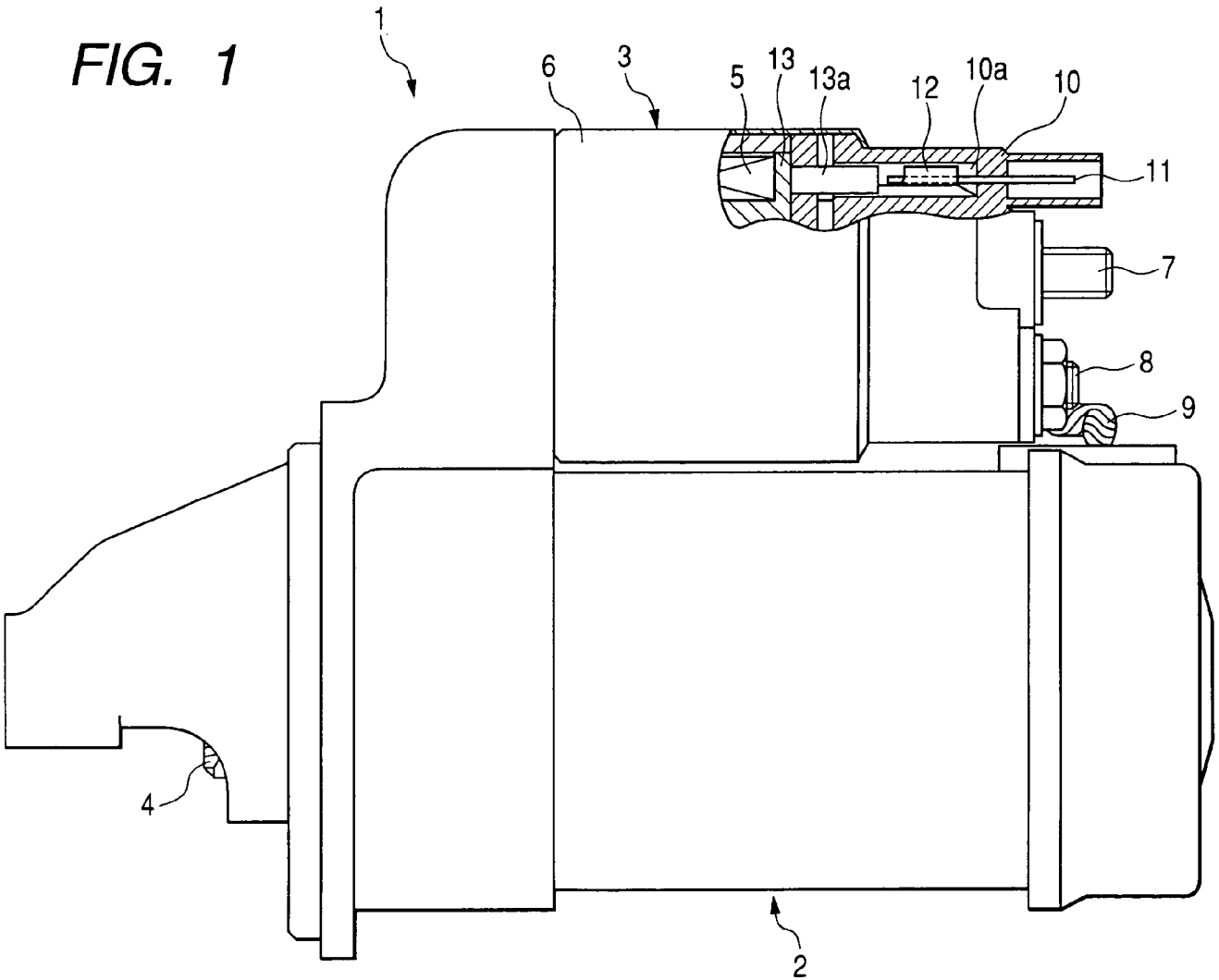
FIG. 1 is a diagram showing cross-sectional views of major parts of an electromagnetic switch according to a first embodiment of the invention, which is included in a starter.

FIG. 1 is a diagram showing cross-sectional views of major parts of an electromagnetic switch 3 according to a first embodiment of the invention, which is included in a starter 1. The starter 1 includes a motor 2 for generating a torque to start a vehicle engine, the electromagnetic switch 3 operating to open and close a main contact (to be explained later) provided in an energizing circuit of the motor 2 (referred to as "motor circuit" hereinafter), and a pinion gear 4 to which the torque generated by the motor 2 is transmitted to cause the pinion gear to rotate. The starter 1 operates to start the vehicle engine by transmitting the torque generated by the motor 2 to a ring gear (not shown) of the vehicle engine through the pinion gear 4. The motor 2 is a DC motor that generates the torque at its armature (not shown) when the main contact is closed to supply electric power from a battery (not shown) to the motor 2.

The electromagnetic switch 3 includes an excitation coil 5 and a solenoid 6 having a built-in plunger (not shown). When a starter switch (not shown) is closed to pass a current from the battery to the excitation coil 5, the plunder is moved by a magnetic attraction force produced by the excitation coil 5, as a consequence of which the main contact is closed. When the starter switch is opened to stop the current from flowing to the excitation coil 5, since the magnetic attraction force disappears, the plunger is moved back, as a consequence of which the main contact is opened. The excitation coil 5 is connected to an energization terminal (to be explained later) to be supplied with the current from the battery through this energization terminal.

Figure 2:
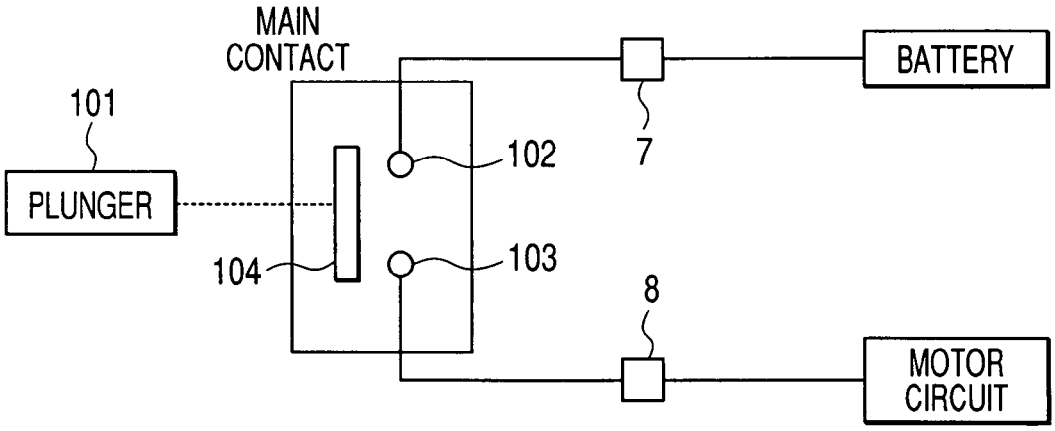
FIG. 2 is a diagram showing connection among a main contact of the electromagnetic switch, an external battery, and a motor circuit of a starter.

As shown in FIG. 2, the main contact is constituted by a pair of fixed contacts 102, 103 connected to the motor circuit through external terminals 7, 8, and a movable contact 104 movable in one with the plunger 101 to make and break the connection between the fixed contacts 102, 103. By making the connection between the fixed contacts 102, 103, the main contact is put in the closed state, and by breaking the connection between the fixed contacts 102, 103, the main contact is put in the open state. The external terminal 7 (may be referred to as a B-terminal 7 hereinafter) is connected to the battery through a not shown battery cable. The external terminal 8 (may be referred to as an M-terminal 8 hereinafter) is connected with a motor lead wire 9 led out from the motor 2. These terminals 7, 8 are fixed to a resin made mold cover 10.

Figure 3:
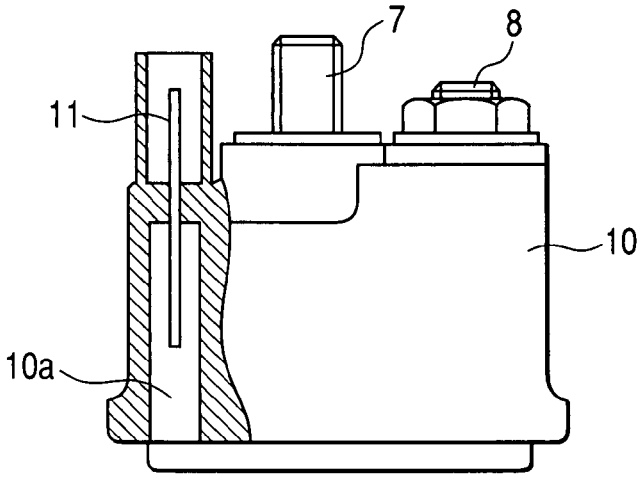
FIG. 3 is a side view of a mold cover including a partial cross-sectional view of the mold cover of the electromagnetic switch.

Next, explanation is made as to the energization terminal. The energization terminal is constituted by a 50 terminal (male terminal) 11, and a connection terminal (female terminal) 12. The 50 terminal 11 is insert-molded in the mold cover 10 in a plate-like shape. A not shown lead wire extending from the starter switch is connected to one end portion of the 50 terminal 11, which projects outside from the mold cover 10. The connection terminal 12 is connected to the other end portion of the 50 terminal 11, which projects inside of the mold cover 10. As shown in FIG. 3, the mold cover 10 is provided with, at its inside, a terminal inserting section 10*a* having a cylindrical shape. The other end portion of the 50 terminal 11 protrudes into this terminal inserting section 10*a*. The connection terminal 12 is pressure-inserted into a terminal holding section 13*a* (see FIGS. 1 and 4) formed in a coil bobbin 13 of the excitation coil 5. A lead wire 5*a* (see FIG. 4) of the excitation coil 5 is connected to the connection terminal 12.

Figure 4:
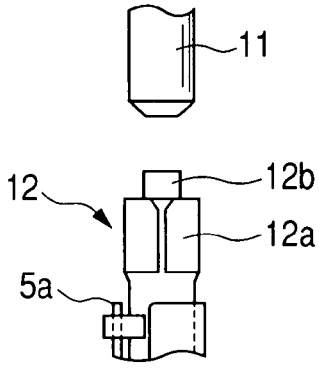
FIG. 4 is a partial plan view of a 50 terminal and a connection terminal of the electromagnetic switch.

The 50 terminal 11 and the connection terminal 12 are electrically connected to each other by mail/female fitting. In this embodiment, the 50 terminal 11 is a male terminal, and the connection terminal 12 is a female terminal. As shown in FIG. 4, the connection terminal 12 has a fitting section 12*a* for receiving therein the 50 terminal 11, and a guide section 12*b* for guiding the front end of the 50 terminal 11 to the fitting section 12*a*. The guide section 12*b* is formed such that it projects from the end of the connection terminal 12, and is inclined backward with respect to the fitting section 12*a*. The 50 terminal 11 and the connection terminal 12 are electrically connected to each other when the connection terminal 12 is inserted into the terminal inserting section 10*a* formed in the mold cover 10, and consequently the 50 terminal 11 fits into the fitting section 12*a* at the time of assembling the mold cover 10 to the solenoid 6.

The above described first embodiment offers the following advantages.

Since the 50 terminal 11 is insert-molded in the mold cover 10, no gap is present between the mold cover 10 and the 50 terminal 11. This makes it possible to suppress the 50 terminal 11 from vibrating when the electromagnetic switch 3 is applied with a large vibrational load. Since the connection terminal 12 to which the lead wire 5*a* of the excitation coil 5 is connected is pressure-fitted into the coil bobbin 13, it is also possible to suppress the connection 12 terminal from vibrating. Hence, according to this embodiment, it is possible to prevent the lead wire 5*a* of the excitation coil 5 from breaking due to vibration, to thereby provide the electromagnetic switch 3 with high vibration resistance.

The 50 terminal 11 and the connecting terminal 12 are configured to be connected to each other by male/female fitting. This configuration makes it possible to easily connect the 50 terminal 11 with the connecting terminal 12, and also to reduce the parts count compared to the conventional electromagnetic switch in which a bolt is used as the 50 terminal. Since the 50 terminal 11 is a male terminal having a simple shape (plate-like shape), the 50 terminal 11 can be easily insert-molded in the mold cover 10, and may have a coupler shape with high water resistance.

Since the terminal inserting section 10*a* is provided inside the mold cover 10, and the connection terminal 12 is provided with the guide section 12*b*, the connecting work of the 50 terminal 11 and the connection terminal 12 can be facilitated. More specifically, since the connection terminal 12 is inserted into the terminal inserting section 10*a* formed in the mold cover 10 at the time of assembling the mold cover 10 to the solenoid 6, the other end portion of the 50 terminal 11 projecting into the terminal inserting section 10*a* and the connecting terminal 12 are aligned with each other. In addition, since the front end of the 50 terminal 11 is guided by the guide section 12*b* provided in the connection terminal 12 at the time of fitting the front end of the 50 terminal 11 into the fitting section 12*a* of the connection terminal 12, any positional misalignment between the 50 terminal 11 and the connection terminal 12 can be remedied. This makes it possible to perform male/female fitting between the 50 terminal 11 and the connection terminal 12 easily and reliably.

Figure 5:
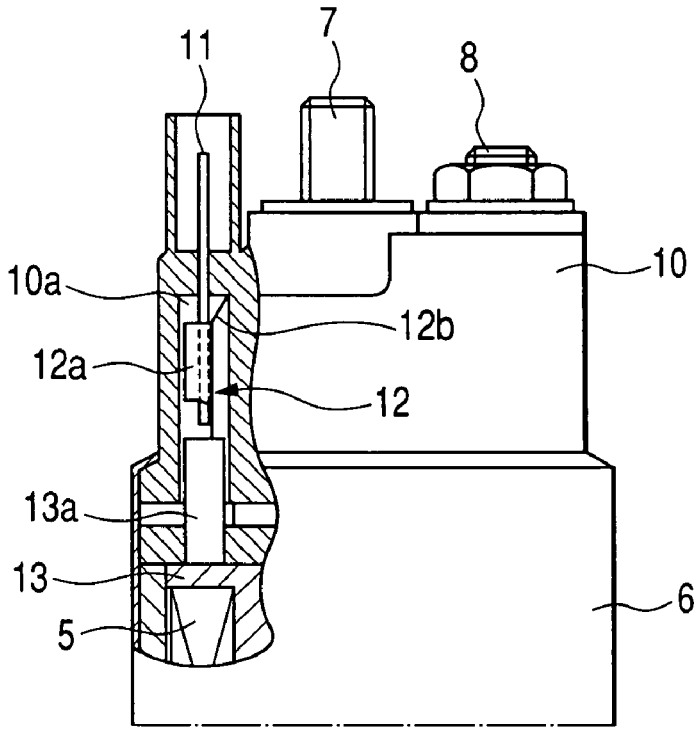
FIG. 5 is a cross-sectional view of the 50 terminal and the connection terminal fitted to each other.
Figure 6:
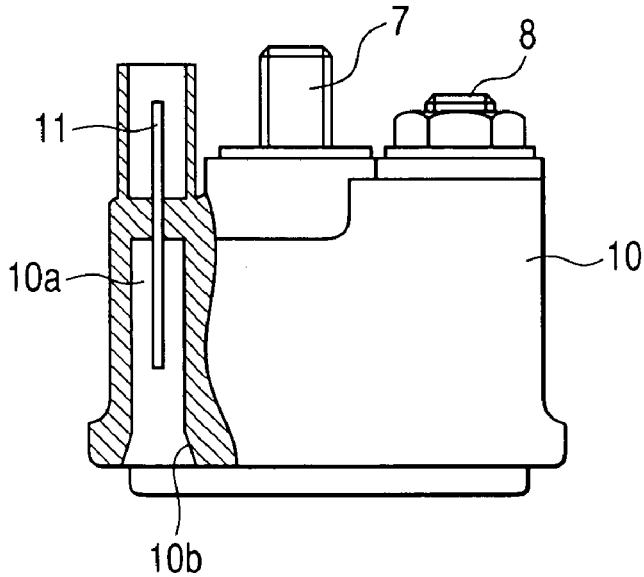
FIG. 6 is a side view of the mold cover including a partial cross-sectional view of the mold cover of a variant of the electromagnetic switch of the first embodiment.

As shown in FIG. 5, the connection terminal 12 may be male/female-fitted to the 50 terminal 11 within the terminal inserting section 10*a* in such a state that a free end of the guide section 12*b* is in contact with the inner periphery of the terminal inserting section 10*a*. In this case, since the free end of the guide section 12*b* which is susceptible to vibration is supported, the effect of suppressing the vibration of the energization terminal can be improved. As shown in FIG. 6, the terminal inserting section 10*a* may be formed with a chamfered portion 10*b* at its entrance. In this case, since the entrance of the terminal inserting section 10*a* has a tapered shape, the insertion of the connection terminal 12 into the terminal inserting section 10*a* becomes easy, to thereby facilitate the assembling work.

Second Embodiment

Figure 7A:
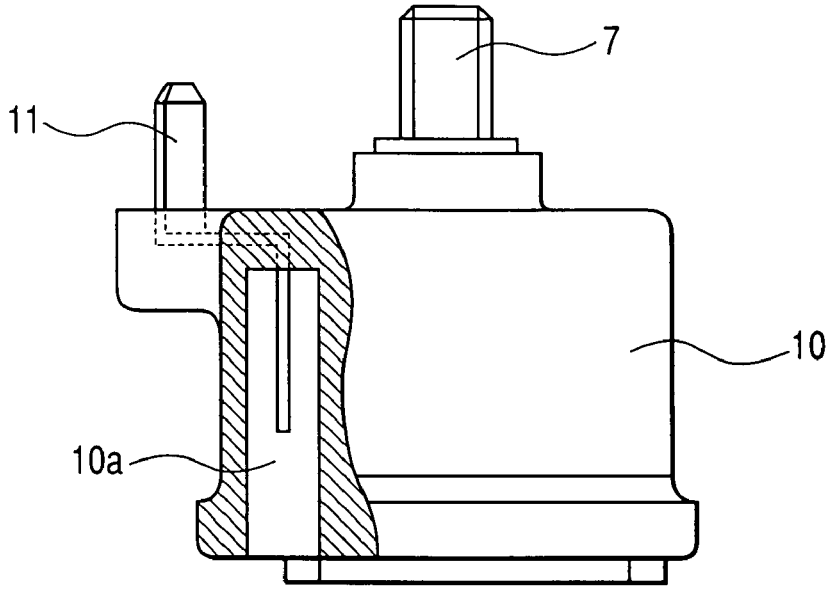
FIG. 7A is a side view of a mold cover including a partial cross-sectional view of the mold cover of an electromagnetic switch according to a second embodiment of the invention.
Figure 7B:
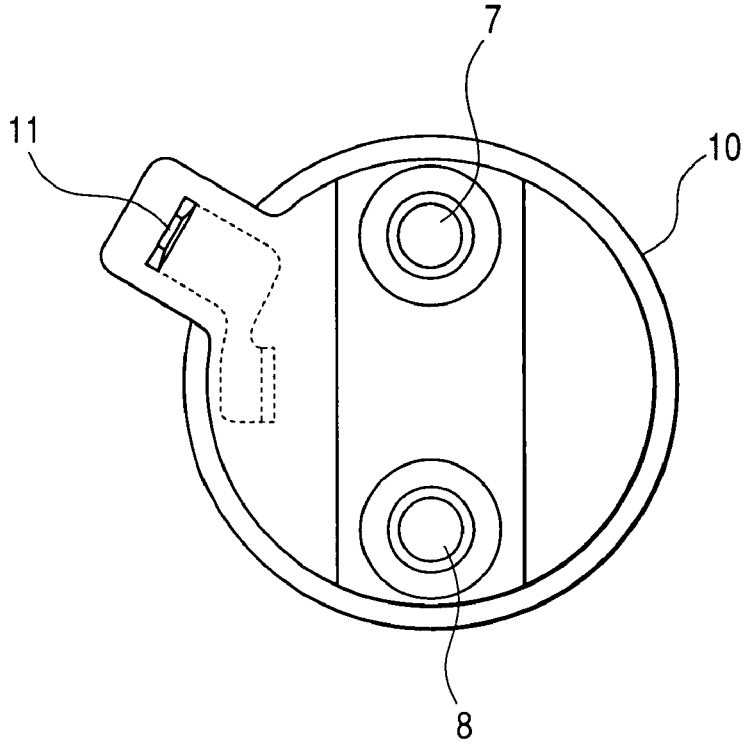
FIG. 7B is an axial plan view of the electromagnetic switch according to the second embodiment of the invention.

FIG. 7A is a side view of the mold cover 10 including a partial cross-sectional view of the mold cover 10 of the electromagnetic switch according to a second embodiment of the invention, and FIG. 7B is an axial plan view of this mold cover 10. The second embodiment is an example in which the 50 terminal 11 insert-molded in the mold cover 10 is bent within the mold cover 10. As shown in FIG. 7A, the 50 terminal 11 is bent so as to have a section extending in the radial direction of the mold cover 10 between one end portion thereof projecting outside from the mold cover 10 and the other end portion projecting inside the mold cover 10. Accordingly, in the second embodiment, the one end portion of the 50 terminal 11 is led outside the outer periphery of the mold cover 10 as shown in FIG. 7B. According to the second embodiment, the position to which the one end portion of the 50 terminal 11 is led outside the mold cover 10 can be set arbitrarily without being affected by the positions of the B-terminal 7 and the M-terminal 8 fixed to the mold cover 10. In addition, the one end portion of the 50 terminal 11 can be led not only in the axial direction, but also in the radial direction of the mold cover 10.

Third Embodiment

Figure 8:
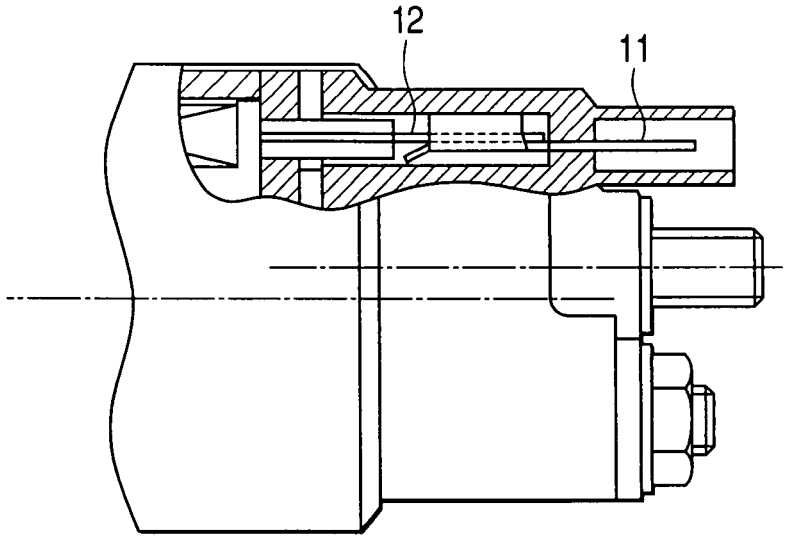
FIG. 8 is a diagram showing cross-sectional views of major parts of an electromagnetic switch according to a third embodiment of the invention.
Figure 9:
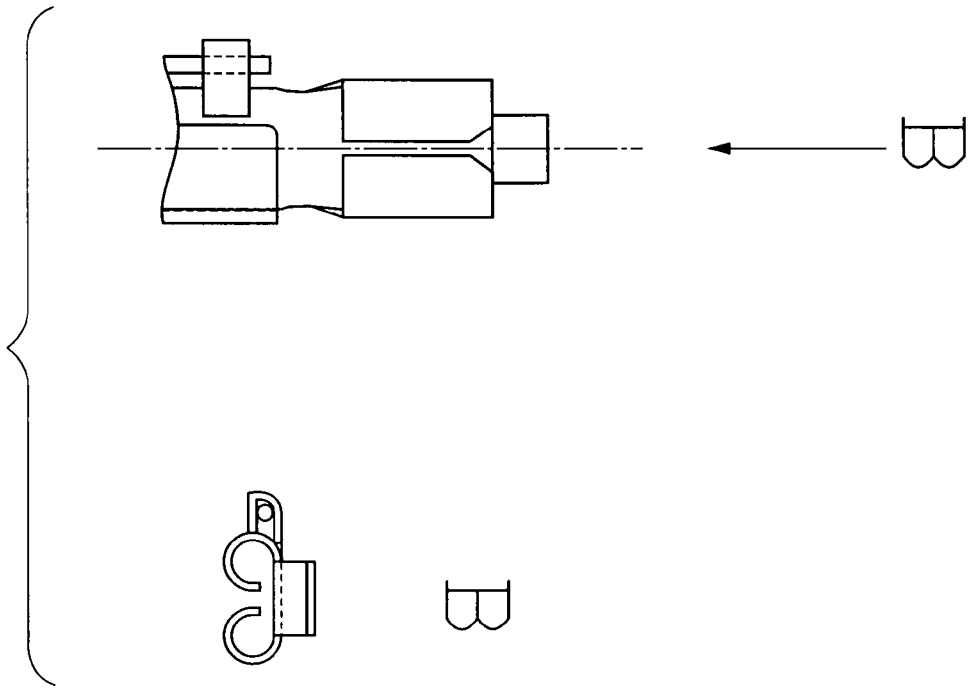
FIG. 9 is a diagram showing a fitting section provided in a 50 terminal of the electromagnetic switch according to the third embodiment of the invention.
Figure 10:
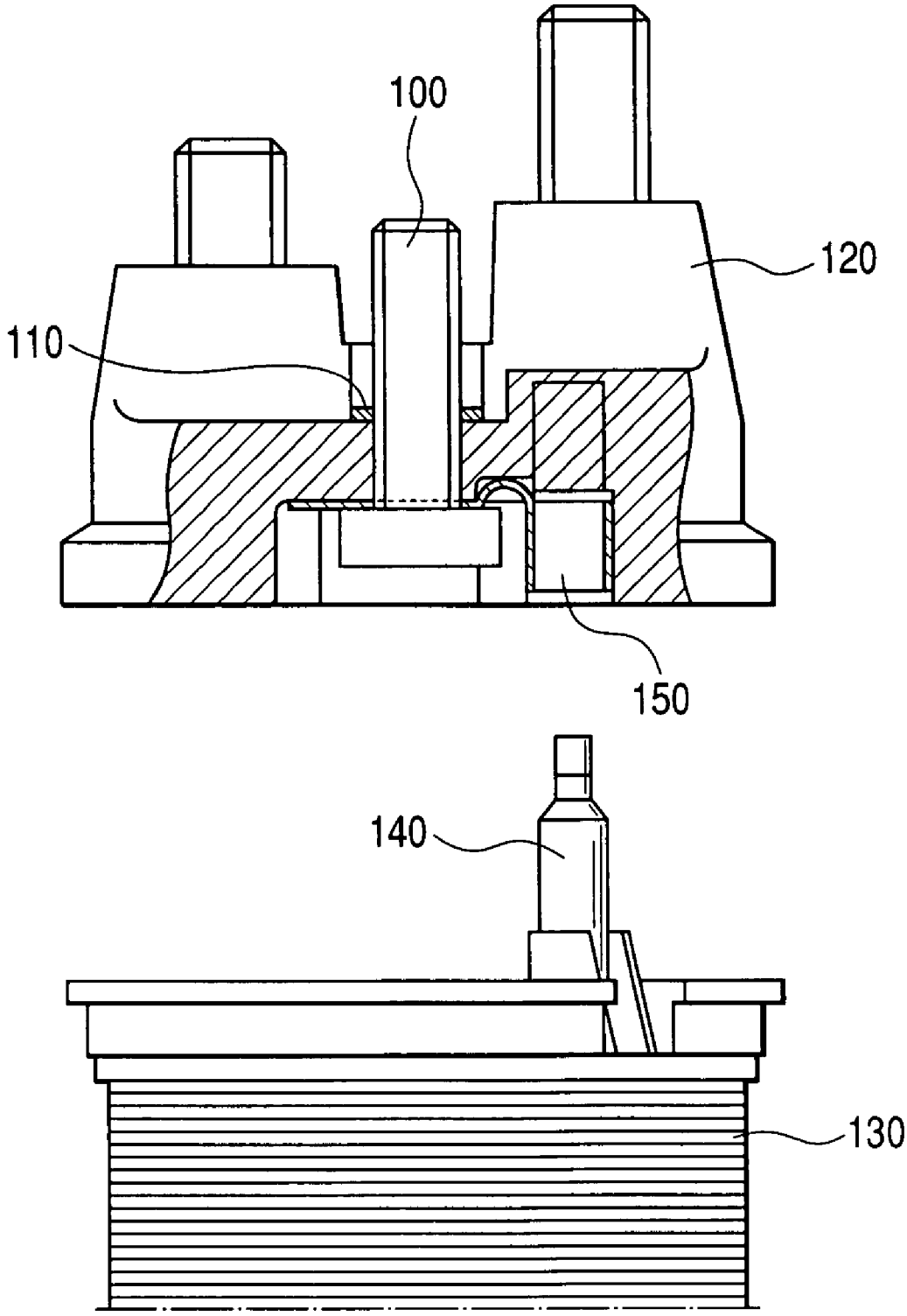
FIG. 10 is a cross-sectional view of a conventional electromagnetic switch in which a bolt is used as a 50 terminal.

In the above described first and second embodiments, the 50 terminal 11 insert-molded in the mold cover 10 is a male terminal, and the connection terminal 12 fixed to the coil bobbin 13 of the excitation coil 5 is a female terminal, however it may be vice versa. That is, as shown in FIG. 7, it is possible that the 50 terminal 11 is a female terminal having a fitting section as shown in FIG. 8, and the connection terminal 12 is a male terminal having a plate-like shape.

The above explained preferred embodiments are exemplary of the invention of the present application which is described solely by the claims appended below. It should be understood that modifications of the preferred embodiments may be made as would occur to one of skill in the art.

What is claimed is:

1. An electromagnetic switch for use in a starter comprising:

an excitation coil;

an energization terminal through which a current is supplied to the excitation coil from an external battery, the energization terminal including:

a male terminal having a plate-like shape; and a female terminal fixed to a coil bobbin of the excitation coil, the female terminal connected to a lead wire of the excitation coil and provided with a fitting section to which the male terminal is fitted such that the male and female terminals are electrically connected to each other, a mold cover made of resin and housing the energization terminal, the mold cover being formed with a terminal inserting section that receives the female terminal, the male terminal being insert-molded into the fitting section formed in the female terminal within the terminal inserting section of the mold cover; and a terminal holding section formed in the coil bobbin of the excitation coil, the female terminal being pressure-inserted into the terminal holding section, wherein the female terminal is provided with a guide section for guiding an end of the male terminal to the fitting section, the guide section being positioned at an incline with respect to the fitting section, a free end of the guide section being in contact with an inner surface of the terminal inserting section, and a free end of the guide section being in contact with the inner surface of the terminal inserting section.

2. The electromagnetic switch according to claim 1, wherein an entrance of the terminal inserting section is tapered.

3. The electromagnetic switch according to claim 1, wherein the female terminal is bent within the mold cover.

* * * * *